United States Patent [19]

Fernandez, III

[11] 4,287,452

[45] Sep. 1, 1981

[54] MULTIPLE FILAMENT ELECTRIC LAMP

[76] Inventor: Leslie U. Fernandez, III, R.D. 3, Box 364, Chippewa Rd., Putnam Valley, N.Y. 10579

[21] Appl. No.: 99,425

[22] Filed: Dec. 3, 1979

[51] Int. Cl.[3] ..... H01J 7/44; H01J 17/34; H01J 19/78; H01K 1/62

[52] U.S. Cl. ..... 315/65; 313/316; 315/68; 315/64

[58] Field of Search ..... 315/64, 65, 66, 67, 315/68, 69; 313/316

[56] References Cited

U.S. PATENT DOCUMENTS

| | | | |
|---|---|---|---|
| 1,456,568 | 5/1923 | Quandt | 315/65 |
| 2,862,147 | 11/1958 | Conti | 315/65 |
| 3,382,403 | 5/1968 | Lloyd | 315/65 |
| 3,886,400 | 5/1975 | Dill | 315/64 |
| 3,983,447 | 9/1976 | Mark et al. | 315/64 |
| 4,121,134 | 10/1978 | Fontenelle | 315/64 |
| 4,179,637 | 12/1979 | Santora | 315/65 |

*Primary Examiner*—Saxfield Chatmon, Jr.
*Attorney, Agent, or Firm*—Roger S. Benjamin

[57] ABSTRACT

A multiple filament incandescent lightbulb automatically places an unused alternate filament in a closed electric circuit upon rupture of an active filament. The alternate filament is placed in a closed circuit by release of an elastically deformed switching member originally held in place by the active filament.

14 Claims, 6 Drawing Figures

MULTIPLE FILAMENT ELECTRIC LAMP

BACKGROUND OF THE INVENTION

A long-life incandescent electric lightbulb having a low frequency of replacement is desirable for many applications. This need has been met in the past with a variety of lightbulb design modifications.

Lightbulb filaments that operate at lower than normal temperatures have extended life. Unfortunately, low temperature filaments have reduced visible light output and are energy inefficient.

Other design modifications for increasing incandescent lightbulb life include the use of multiple filaments contained in one lightbulb envelope. U.S. Pat. Nos. 3,260,888, 3,983,447, and 2,317,027 are representative of such multiple filament designs. These bulbs have the common feature of an active filament and an unused filament. These prior art multiple filament devices require in each case active intervention by a user to activate the unused filament upon destruction of the original active filament. Such user intervention is often inconvenient and may be impractical when the lightbulb is in a remote location.

THE INVENTION

This invention is an improvement in multiple filament electric incandescent lightbulbs. The lightbulb of this invention automatically places an unused alternate filament in a closed electric circuit upon rupture of an active filament.

Another aspect of this invention is an improved multiple filament containing mount suitable for assembly with a lightbulb base and envelope. The mount provides an arrangement of parts which automatically places an unused alternate filament in a closed electric circuit upon rupture of an active filament.

DETAILED DESCRIPTION OF THE INVENTION

The incandescent multiple filament electric lightbulb of this invention comprises a filament holding mount in a light transmitting envelope having a base to accept electric current.

The lightbulb envelope protects the internal parts of the lightbulb and may be fabricated in any convenient shape from transparent materials such as glass or quartz. The sealed lightbulb envelope may contain a vacuum or an inert gas atmosphere such as nitrogen, argon, or krypton. In addition, the envelope may contain a gas or vapor (e.g., mercury vapor) which alters the spectral characteristics of the lightbulb.

The base is that part of the lightbulb containing conducting and insulating sections which serve to connect the internal leads to an external source of electric current. It is advantageous to provide the lightbulb with a standard base of the screw or bayonet type.

THE LIGHTBULB MOUNT

The extended life and automatic filament replacement of the lightbulb of this invention arises from the combination of elements comprising the lightbulb mount and the cooperative association of the mount elements.

The essential elements of the lightbulb mount are (A) the filaments, (B) the leads, (C) the switching member(s), and (D) the support means.

A filament is one or more wires, ribbons, bars, tubes, or coils of conductive material held between two leads and capable of incandescing in a closed electric circuit. The filament may be made of carbon or a refractory metal such as tungsten. Each of the filaments in the mount may have the same or different size, shape, composition, or electrical resistance. Multiple filaments may be formed from a continuous length of filament material by dividing the filament into sections with electric leads. Each filament of this invention is electrically independent of all other filaments. The filaments in the mount are arranged so that only one filament may incandesce at one time.

The leads are electric conductors generally in the form of metal wires. The leads carry electric current from the base to the switching member(s) and filaments. Leads are typically made from nickel, copper, or nickel-iron core clad in copper.

The mount contains at least one part designated a "switching member". The switching member is a solid construct which functions to switch electric current to an unused alternate filament upon rupture of an intact filament.

The required parts of the switching member are the projection, the elastic component, and the conductive arm.

The projection on each switching member functions to maintain physical contact of the switching member with the filament (cold or incandescent) under conditions normal to lightbulb use. The switching member projection uses a filament to hold the switching member in position. The switching member projection may take any convenient form such as a tab, loop, hook, or knob.

The elastic component of the switching member functions to make the member elastically deformable and movable from a stressed to a relaxed orientation. The elastic component may be any mechanical part capable of storing energy. Examples of suitable elastic components are helical or coil springs, torsion bars, and leaf springs.

The conductive arm of the switching member functions to transfer electric current to an unused filament upon rupture of an active filament. The conductive arm is typically a metal extension of the switching member which is brought into electrical contact with leads or terminals connected to alternate filaments.

The switching member may take any convenient shape or form having the required parts. The entire switching member may be made of metal if desired. For example, a helical metal spring terminating in a loop, a torqued metal bar having a filament engaging tab, and a flexed resiliant metal rod equipped with a filament engaging hook are suitable as switching member elements. A lightbulb mount assembly may have more than one type of switching member if desired.

The support means element of the mount serves to support and position the filament, leads and switching member(s). The support means may have a configuration similar to a conventional lightbulb with a button rod terminating in a button and support wires to position a filament and leads. The support means may be made of glass, quartz, mica, ceramic or other refractory material.

COOPERATIVE ASSOCIATION OF THE MOUNT ELEMENTS

The filaments, leads, switching member(s) and support means cooperate to automatically place an unused filament in a closed electric circuit upon rupture of an active filament.

The lightbulb mount of this invention has two leads connected to a first filament (the filament which first incandesces in an unused mount) to form a closed electric circuit. The alternate filament(s) in the lightbulb mount have less than two attached current carrying leads and are present in an open circuit in the unused mount.

The first filament is contacted by one switching member. The switching member physically contacts the intact first filament (whether cold or incandescent) with its projecting part in an elastically deformed condition and exerts a nondestructive pressure on the filament. The intact filament is an obstacle to the switching member and effectively prevents its movement to another position.

The application of nondestructive pressure to filaments by elastically deformed members is a known technique shown in U.S. Pat. Nos. 1,105,050; 3,253,178; and 3,870,920; the disclosures of which are incorporated herein by reference.

The elastically deformed switching member restrained by an intact filament is said to be at its first position. The term, "elastically deformed" denotes that the elastic component of the switching member has sufficient potential energy to move the switching member to its second position. An elastically deformed component is typically in a state of compression, extension, or torque.

Each switching member is capable of moving to an elastically relaxed position. Movement to an elastically relaxed position (the second position) happens upon rupture of the filament and release of the switching member projection.

The movement of the switching member from its first position to its second position is the means for placing an unused filament in a closed electric circuit. Movement of the conductive arm part of the switching member serves to switch electric current. The arm makes electrical contact with a lead or terminal of an alternate filament when the switching member assumes its second position.

Switching member(s) may be used with any number of filaments in a mount. Switching members are associated with all but one of the mount filaments since no switching function is required upon rupture of the last filament.

Other objects and features of the present invention will become apparent from the accompanying drawings which disclose several embodiments of the invention. It is to be understood that the drawings are designed for the purpose of illustration only, and are not intended as a definition of the limits and scope of the invention disclosed.

BRIEF DESCRIPTION OF THE DRAWINGS

FIG. 1 illustrates a light bulb having an envelope (1), an electrically conductive base (3) fixedly attached to the envelope, and a support stem (5) which positions the elements of the mount in the interior of the bulb. Leads (7) and (9) supply electric current to filament (11) which is in a closed electric circuit. Alternate filament (13) is connected to leads (7) and (15). Lead (15) does not make electrical contact with lead (9) so that filament (13) is in an open electric circuit and does not incandesce. Lead (9) supplying current to first filament (11) terminates in a switching member (17) comprising an elastically deformed helical spring, an electrically conductive wire arm (19), and a filament engaging loop (21). The filament engaging loop (21) of switching member (17) is held at a first position which prevents contact of lead (9) with lead (15). Lead (15) is connected to alternate filament (13) and terminates in a hook which is positioned to partially encircle but not touch lead (9). Upon rupture of first filament (11)—rupture not illustrated—lead (9) containing switching member (17) snaps toward the periphery of envelope (1) and is stopped at an elastically relaxed position by the hook on lead (15). The electrical contact of leads (9) and (15) results in incandescence of alternate filament (13) and the lightbulb continues in operation.

FIG. 2B illustrates part of a mount assembly supported on an insulating plate suitable for placement in a lightbulb envelope. The illustrated mount assembly contains three filaments and two switching members.

Figure 1:
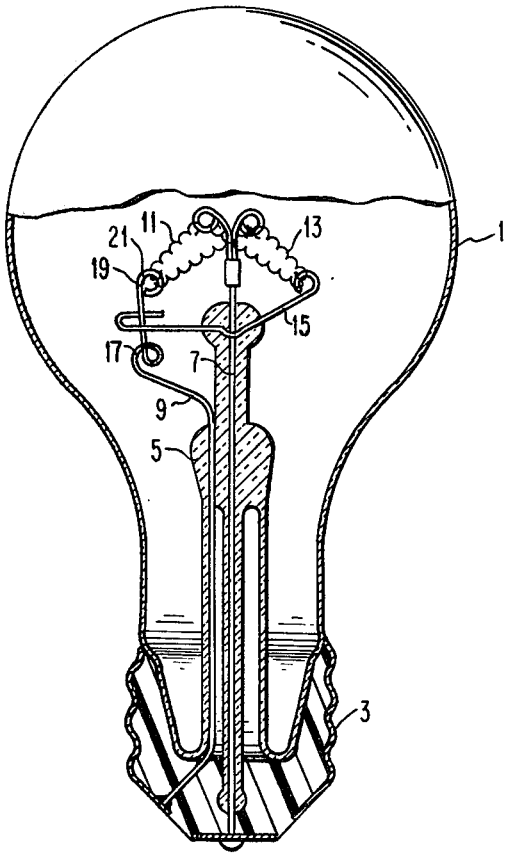
FIG. 1 is a perspective view of a lightbulb of the invention having a first filament and one alternate filament.

First filament (23) and alternate filaments (25) and (27) are supported on conductive posts (29), (31), (33), (35), (37), and (39). Electric current is supplied to the filaments and switching members by leads (41) and (43) coming from electric plug (45). Both first filament (23) and alternate filament (25) are contacted by projections (47) and (49) on switching members (51) and (53) respectively. Switching members (51) and (53) are elastically deformed because of torque in the switching member stem and are held at a first position by filaments (23) and (25). Electrically conductive arms (55) and (57) on the switching members extend into space and do not conduct electric current when held at the first position by each filament. Rupture of first filament (23)—rupture not illustrated—results in rotation of switching member (51) and places electrically conductive arm (55) of switching member (51) across conductive posts (29) and (31). Consequently, the rupture of filament (23) places filament (25) in a closed electric circuit. The action of switching member (51) is duplicated when filament (25) ruptures and switching member (53) rotates to a second position to place alternate filament (27) in a closed electric circuit.

Figure 2A:
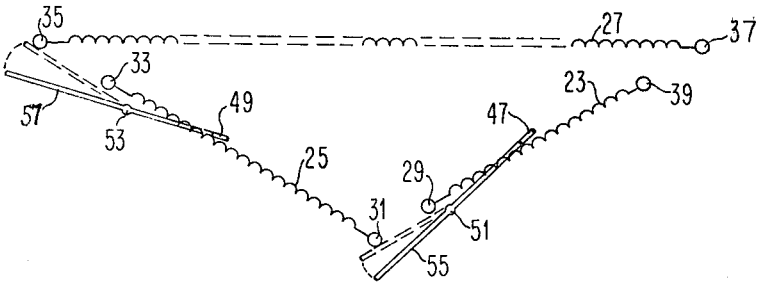
FIG. 2A is a top view of the lightbulb mount of the invention shown in FIG. 2B.
Figure 2B:
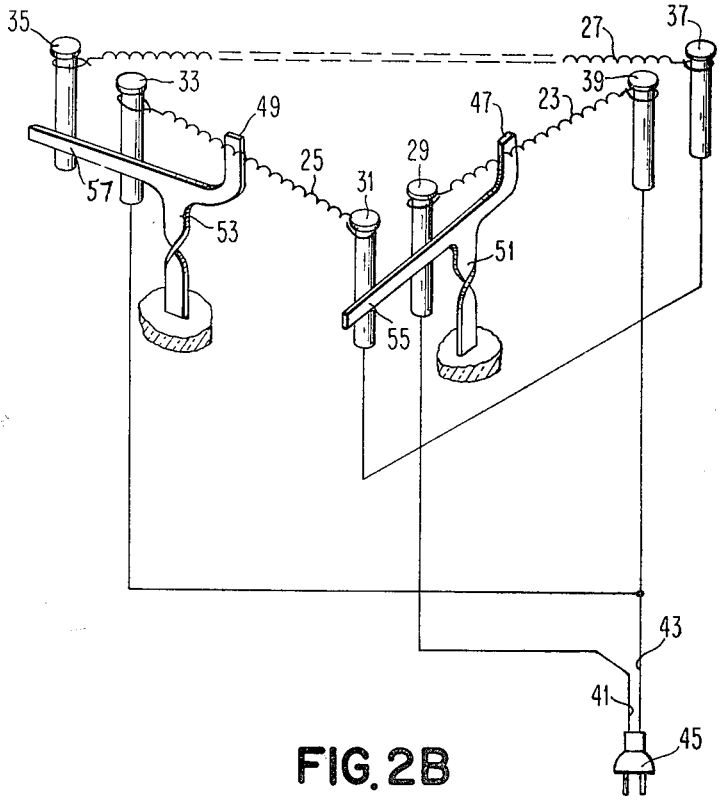
FIG. 2B is a perspective view of a lightbulb mount of the invention having a first filament, a primary alternate filament, and a secondary alternate filament.

FIG. 2A is a top view of the mount assembly shown in FIG. 2B. The top view shows the first position of switching members (51) and (53) by solid lines and the second position of rotated switching members by dashed lines.

Figure 3A:
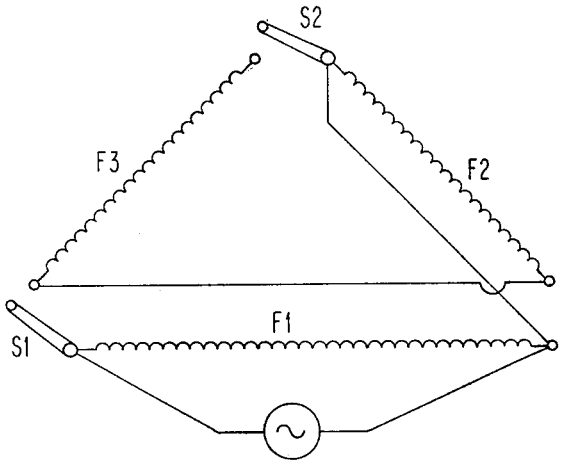
FIG. 3A is a circuit diagram of a lightbulb of the invention having a first filament with associated switching member, a primary alternate filament with associated switching member, and a secondary alternate filament, all three filaments being intact.
Figure 3B:
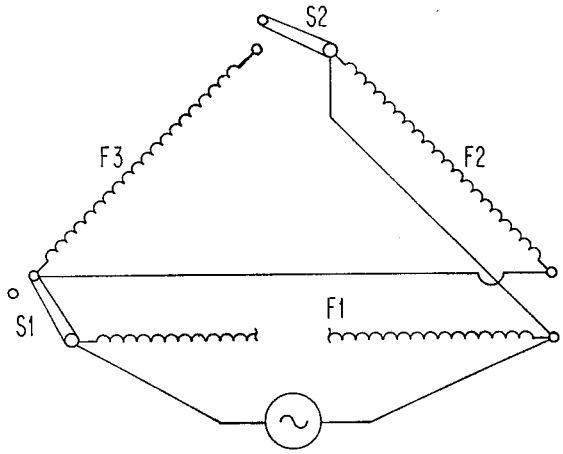
FIG. 3B is a circuit diagram of a lightbulb of the invention having a ruptured first filament, an intact primary alternate filament, and an intact secondary alternate filament.
Figure 3C:
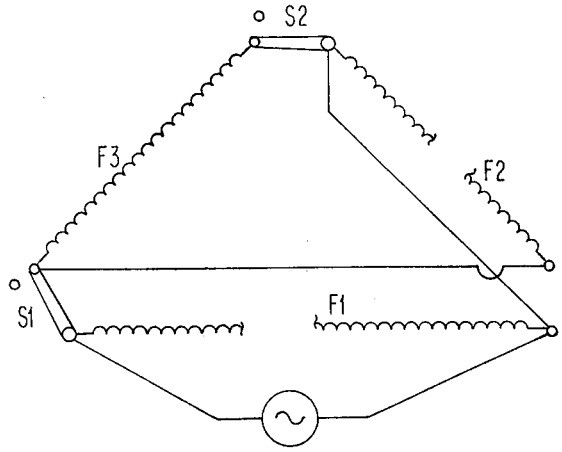
FIG. 3C is a circuit diagram of a lightbulb of the invention having a ruptured first filament, a ruptured primary alternate filament, and an intact secondary alternate filament.

FIGS. 3A, 3B and 3C are circuit diagrams of a three filament, two switching member lightbulb according to this invention. The circuit diagrams are illustrative of the electric circuit employed in the lightbulb mount shown in FIGS. 2A and 2B.

FIG. 3A shows the initial electric circuit of a lightbulb with all filaments intact and only the first filament in a closed electric circuit.

FIG. 3B shows the electric circuit in the second stage of lightbulb life. The first filament F1 has ruptured and switching member S1 initially in contact with the first filament has moved to its second position thereby placing alternate filament F2 in a closed circuit.

FIG. 3C shows the electric circuit in the final stage of lightbulb life after rupture of both the first filament and one of the two alternate filaments. Release of the second switching member to its second position by the rupture of filament F2 places the last filament F3 in a closed electric circuit.

While only a few embodiments have been described in the accompanying FIGURES, it is contemplated that many changes and modifications may be made thereunto without departing from the scope of the invention.

I claim:

1. An incandescent electric lightbulb mount comprising:

A. a first filament consisting essentially of conductive material capable of incandescing in a closed electric circuit, B. one or more alternate filaments consisting essentially of material capable of incandescing in a closed electric circuit, C. leads placing said first filament in a closed electric circuit, D. leads placing said alternate filament(s) in an open electric circuit, E. one or more switching members, the number of switching members being equal to one less than the total number of filaments in said mount, said switching members having as parts; (i) a projection to contact a filament, (ii) an elastic component to make said member elastically deformable, and (iii) a conductive arm to transfer electric current, F. a first filament switching member contacting said first filament and a switching member associated with and contacting each but one of said alternate filaments, wherein each of said switching member(s) is held in an elastically deformed first position by its associated filament, each of said switching members being arranged so that upon rupture of a filament the associated switching member moves to an elastically relaxed second position and thereby places an unused alternate filament in a closed electric circuit, G. support means for positioning said leads, filaments, and switching member(s).

2. The lightbulb mount of claim 13 having a first filament with associated first filament switching member, a primary alternate filament with associated primary alternate filament switching member, and a secondary alternate filament.

3. The lightbulb mount of claim 1 having a first filament with associated first filament switching member and a primary alternate filament.

4. The lightbulb mount of claim 1 wherein the switching member(s) parts comprising (i) a projection, (ii) an elastic component, and (iii) a conductive arm are each made of metal.

5. The lightbulb mount of claim 1 wherein the switching member(s) have a form selected from the group consisting of a helical metal spring, a torqued metal bar, and a flexed metal rod.

6. The lightbulb mount of claim 1 wherein the filaments contain tungsten.

7. The lightbulb mount of claim 1 wherein the switching member projection has a form selected from the group consisting of a hook, a tab, and a loop.

8. An incandescent electric lightbulb comprising (1) an envelope; (2) a mount containing support means, filaments, and leads; and (3) a base for connecting the leads and filament to a source of electric current; wherein the improvement is a mount comprising:

A. a first filament consisting essentially of conductive material capable of incandescing in a closed electric circuit, B. one or more alternate filaments consisting essentially of material capable of incandescing in a closed electric circuit, C. leads placing said first filament in a closed electric circuit, D. leads placing said alternate filament(s) in an open electric circuit, E. one or more switching members, the number of switching members being equal to one less than the total number of filaments in said mount, said switching members having as parts; (i) a projection to contact a filament, (ii) an elastic component to make said member elastically deformable, and (iii) a conductive arm to transfer electric current, F. a first filament switching member contacting said first filament and a switching member associated with and contacting each but one of said alternate filaments, wherein each of said switching member(s) is held in an elastically deformed first position by its associated filament, each of said switching members being arranged so that upon rupture of a filament the associated switching member moves to an elastically relaxed second position and thereby places an unused alternate filament in a closed electric circuit, G. support means for positioning said leads, filaments, and switching member(s).

9. The lightbulb of claim 8 having a mount containing a first filament with associated first filament switching member, a primary alternate filament with associated primary alternate filament switching member, and a secondary alternate filament.

10. The lightbulb of claim 8 having a first filament with associated first filament switching member and a primary alternate filament.

11. The lightbulb of claim 8 wherein the switching member(s) parts comprising (i) a projection, (ii) an elastic component, and (iii) a conductive arm are each made of metal.

12. The lightbulb of claim 8 wherein the switching member(s) have a form selected from the group consisting of a helical metal spring, a torqued metal bar, and a flexed metal rod.

13. The lightbulb of claim 8 wherein the filaments contain tungsten.

14. The lightbulb of claim 8 wherein the switching member projection has a form selected from the group consisting of a hook, a tab, and a loop.

* * * * *

UNITED STATES PATENT AND TRADEMARK OFFICE

CERTIFICATE OF CORRECTION

PATENT NO. : 4,287,452

DATED : September 1, 1981

INVENTOR(S) : Leslie U. Fernandez III

It is certified that error appears in the above-identified patent and that said Letters Patent are hereby corrected as shown below:

Column 5, line 59, after the fifth word of Claim 2, delete the numeral "13" and substitute the numeral --1--.

Signed and Sealed this

*Nineteenth* Day of *January 1982*

[SEAL]

*Attest:*

GERALD J. MOSSINGHOFF

*Attesting Officer*

*Commissioner of Patents and Trademarks*